US011186951B2

(12) United States Patent
Mori et al.

(10) Patent No.: US 11,186,951 B2
(45) Date of Patent: Nov. 30, 2021

(54) METHOD FOR ENHANCING EFFICIENCY OF HEATING WITH STEAM, AND PAPERMAKING METHOD

(71) Applicant: KURITA WATER INDUSTRIES LTD., Tokyo (JP)

(72) Inventors: Shintaro Mori, Tokyo (JP); Hideki Nishida, Tokyo (JP); Shogo Ujiie, Tokyo (JP); Qian Lin, Tokyo (JP)

(73) Assignee: KURITA WATER INDUSTRIES LTD., Tokyo (JP)

( * ) Notice: Subject to any disclaimer, the term of this patent is extended or adjusted under 35 U.S.C. 154(b) by 0 days.

(21) Appl. No.: 16/641,005

(22) PCT Filed: Nov. 21, 2018

(86) PCT No.: PCT/JP2018/042945
§ 371 (c)(1),
(2) Date: Feb. 21, 2020

(87) PCT Pub. No.: WO2019/159469
PCT Pub. Date: Aug. 22, 2019

(65) Prior Publication Data

US 2020/0407914 A1 Dec. 31, 2020

(30) Foreign Application Priority Data

Feb. 15, 2018 (JP) ..... JP2018-025228

(51) Int. Cl.
*D21F 5/18* (2006.01)

(52) U.S. Cl.
CPC ..... *D21F 5/182* (2013.01)

(58) Field of Classification Search
CPC .. D21F 5/182; D21F 5/02; D21F 5/10; D21H 17/07; F26B 3/20; F26B 23/10; F26B 13/18
See application file for complete search history.

(56) References Cited

U.S. PATENT DOCUMENTS 6,587,753 B2 7/2003 Fowee
2001/0047221 A1* 11/2001 Fowee ..... C02F 5/04 700/202

(Continued)

FOREIGN PATENT DOCUMENTS

GA 2800545 A1 11/2011
JP H08-14536 B2 2/1996

(Continued)

OTHER PUBLICATIONS

Japan Patent Office, "Notification of Reasons for Cancellation for Japanese Patent Application No. 2020-700324," Jul. 28, 2020.

(Continued)

*Primary Examiner* — Eric Hug
*Assistant Examiner* — Matthew M Eslami
(74) *Attorney, Agent, or Firm* — Manabu Kanesaka

(57) ABSTRACT

When the efficiency of heating with steam is enhanced by adding a condensed water film formation-suppressing amine in a heating step of heating a material to be heated with the steam via a metallic material, the amount of the condensed water film formation-suppressing amine to be added is controlled based on any of the concentration of the condensed water film formation-suppressing amine in a drain, the pH of the drain, the electroconductivity of the drain, the amount of the drain, the amount of the steam, the temperature of the drain, the temperature of the metallic material, and the amount of the metallic material eluted in the drain.

1 Claim, 2 Drawing Sheets

(56) References Cited

U.S. PATENT DOCUMENTS

| | | | | |
|---|---|---|---|---|
| 2013/0119303 | A1 | 5/2013 | Hater et al. | |
| 2014/0017120 | A1* | 1/2014 | Mori | C23F 11/141 422/7 |
| 2016/0045841 | A1* | 2/2016 | Kaplan | B01D 3/06 429/49 |

FOREIGN PATENT DOCUMENTS

| | | | | |
|---|---|---|---|---|
| JP | 2003-532051 | A | | 10/2003 |
| JP | 2011-012921 | A | | 1/2011 |
| JP | 2011012921 | A | * | 1/2011 |
| JP | 2011-033301 | A | | 2/2011 |
| JP | 2015-117913 | A | | 6/2015 |
| JP | 2017-119893 | A | | 7/2017 |
| JP | 2017119893 | A | * | 7/2017 |
| JP | 2017-154049 | A | | 9/2017 |
| JP | 2019-056524 | A | | 4/2019 |

OTHER PUBLICATIONS

Japan Patent Office, "Notice of Opposition for Japanese Patent No. 6601516," May 1, 2020.

"Technical Guidance Document: Application of Film Forming Amines in Fossil, Combined Cycle, and Biomass Power Dlants," IAPWS TGD8-16, The International Association for the Properties of Water and Steam (IAPWS), Sep. 2016, p. 1-43, Dresden, Germany.

Ryzhenkov, A.V. et al., "Prospects for the application of film-forming amines in power engineering," Surface and Contact Mechanics including Tribology XII, WIT Transactions on Engineering Sciences, 2015, p. 127-137, vol. 91, Moscow Power Engineering Institute, National Research University, Russia.

PCT/ISA/210, "International Search Report for International Application No. PCT/JP2018/042945," dated Feb. 12, 2019.

Japan Patent Office, "Notice of Reasons for Refusal for Japanese Patent Application No. 2018-025228," dated Feb. 12, 2019.

* cited by examiner

METHOD FOR ENHANCING EFFICIENCY OF HEATING WITH STEAM, AND PAPERMAKING METHOD

TECHNICAL FIELD

The present invention relates to a method for enhancing the efficiency of heating with steam in a heating step of heating a material to be heated with the steam via a metallic material. The present invention relates further to a papermaking method adopting the heating efficiency-enhancing method to enhance the production efficiency in a papermaking facility.

BACKGROUND ART

In papermaking factories, food and beverage-manufacturing factories and the like, by heating products with steam, treatments of drying, concentrating or sterilizing the products are carried out. For example, in papermaking facilities, a treatment of drying wet paper having a moisture content of about 50% to having a moisture content of about 5 to 10% using a steam dryer equipped with a rotary drum is carried out.

FIG. 2 is a system diagram illustrating a wet paper drying facility using a Yankee dryer (a dryer composed of one large-diameter cast iron cylinder) as a steam dryer. Feed-water is supplied to boilers 5 via a makeup water apparatus 1, a feed-water tank 2, a pipe 3 and a feed-water header 4. Water vapor generated in the boilers 5 is supplied into a drum 11 of the Yankee dryer via a water vapor pipe 6, a water vapor header 7, a pipe 8, a flow rate regulating valve 9 and a pipe 10.

The drum 11 is rotationally driven in the clockwise direction in FIG. 2. Wet paper P is brought into contact with the peripheral surface of the drum 11 and dried, separated off the peripheral surface, and thereafter fed to a product winding step. The moisture content of the dried paper and the temperature of the drum peripheral surface are measured using sensors, and based on the measurements, the water vapor flow rate is regulated by the valve 9.

Condensed water W generated by condensation of water vapor in the drum is fed to a flash tank 14 via a siphon pipe 12 and a pipe 13, and returned to the feed-water tank 2 via a strainer 15. The condensed water W is pressed against the inner peripheral surface of the drum 11 by a centrifugal force accompanying the rotation of the drum 11 to be lifted in the rotation direction of the drum 11, whereby a water film is formed on the inner peripheral surface of the drum 11.

The drying step of the paper in the papermaking facility involves gradually raising the temperature of moisture and pulp contained in the wet paper to evaporate water. A needed quantity of heat is given by steam in individual dryers so that the paper is dried to a specified moisture content at the dry end (a place where the paper is separated off the peripheral surface of the drum 11).

In order to raise the amount of paper to be produced by raising the efficiency of drying of the wet paper in the drying step, it is needed that the condensed water W generated in the drum 11 is efficiently discharged.

As a countermeasure thereto, a method of causing condensed water film accumulated in a dryer drum to be ununiform by reducing the drum rotation rate to slow the papermaking rate, installing protrusions called spoiler bars in the drum, or otherwise is carried out. The lowered papermaking rate, however, leads to reduction in the amount produced per unit time. The installation of the spoiler bars involves facility renewal and then engineering work.

In order to suppress the formation of the condensed water film in the drum without using these methods, there has been proposed a method of adding a condensed water film formation-suppressing amine, for example, a long-chain aliphatic amine such as octadecylamine, or a polyamine as a contact angle-increasing agent for increasing the contact angle of the drum inner peripheral surface with water (Patent Literatures 1, 2).

PTL1: JP 2011-12921 A

PTL2: JP 2017-181476

By the method of Patent Literatures 1 and 2, the enhancement of the papermaking rate and the enhancement of the amount of paper to be produced can be achieved due to the suppressing effect of the amine added on formation of a condensed water film in a drum of a steam dryer. However, when while the papermaking rate and the amount of steam to be blown into the dryer are varied and adjusted according to the kind and the thickness of paper to be produced, the condensed water film formation-suppressing amine is injected in a fixed amount, the following various problems arise due to excess and deficiency of the condensed water film formation-suppressing amine based on a proper chemical injection amount thereof.

Tacky substances precipitate in too much injection of the chemical agent.

The effect of enhancing the production efficiency reduces in too little injection of the chemical agent.

When the condensed water film formation-suppressing amine is also continuously injected in a short-period non-operating time of a papermaking apparatus, the amount of the chemical agent to be used cannot be optimized and the problem of precipitation of tacky substances in the system also arises.

SUMMARY OF INVENTION

The present invention is a method for more effectively enhancing the efficiency of heating with steam by addition of a condensed water film formation-suppressing amine without involving reduction in the production efficiency and a large-scale facility renewal, in a heating step of heating a material to be heated with the steam via a metallic material. The present invention provides a method for effectively enhancing the heating efficiency, in which by properly controlling chemical injection in the above-mentioned method, various problems caused by excess and deficiency of the condensed water film formation-suppressing amine are improved, and a papermaking method of enhancing the production efficiency in a papermaking facility by adopting the above-mentioned method.

The present inventors have found that the amount of the condensed water film formation-suppressing amine to be injected can be optimized by controlling chemical injection thereof based on one or two or more of the following items (1) to (7) to be analyzed and controlled.

(1) Concentration of a condensed water film formation-suppressing amine in a drain (2) pH of the drain (3) Electroconductivity of the drain (4) Amount of the drain or the steam (5) Temperature of the drain or a metallic material (6) Amount of the metallic material eluted in the drain (7) Tracer substance, such as N,N-diethylhydroxylamine or ammonia, to be blended in a chemical agent The present invention has been achieved based on these findings, and has the following gist.

[1] A method for enhancing the efficiency of heating with steam, including adding a condensed water film formation-suppressing amine in a heating step of heating a material to be heated with the steam via a metallic material, wherein the amount of the condensed water film formation-suppressing amine to be added is controlled based on any one or more of the concentration of the condensed water film formation-suppressing amine in a drain, the pH of the drain, the electroconductivity of the drain, the amount of the drain, the amount of the steam, the temperature of the drain, the temperature of the metallic material, and the amount of the metallic material eluted in the drain.

[2] The method for enhancing the efficiency of heating with steam according to claim 1, wherein the metallic material is rotating.

[3] The method for enhancing the efficiency of heating with steam according to [1] or [2], wherein the heating step is a step of heating the material to be heated using a steam dryer; and the condensed water film formation-suppressing amine is added to a place, of a steam pipe or a steam header for supplying steam to the steam dryer, right before the steam dryer, and the amount of the condensed water film formation-suppressing amine to be added is controlled based on any one or more of the concentration of the condensed water film formation-suppressing amine in a drain of the steam dryer, the pH of the drain, the amount thereof, the temperature thereof and the amount of the metallic material eluted in the drain.

[4] The method for enhancing the efficiency of heating with steam according to any one of [1] to [3], wherein in the heating step, the condensed water film formation-suppressing amine and a neutralizing amine are caused to be concurrently present.

[5] The method for enhancing the efficiency of heating with steam according to any one of [1] to [4], wherein in the heating step, the condensed water film formation-suppressing amine and a tracer substance are caused to be concurrently present, and the concentration of the condensed water film formation-suppressing amine is managed based on the concentration of the tracer substance.

Advantageous Effects of Invention

According to the present invention, in a heating step of heating a material to be heated with the steam via a metallic material, preferably in a heating and drying step, by addition of a condensed water film formation-suppressing amine, the efficiency of heating with the steam can be enhanced due to suppression of the formation of a condensed water film without involving reduction in the production efficiency and a large-scale facility renewal. In this case, by properly controlling the chemical injection amount of the condensed water film formation-suppressing amine, problems, such as precipitation of tacky substances and reduction in the chemical injection effect, caused by excess and deficiency of the condensed water film formation-suppressing amine are improved and a large heating efficiency-enhancing effect can stably be attained.

DESCRIPTION OF EMBODIMENTS

Figure 1:
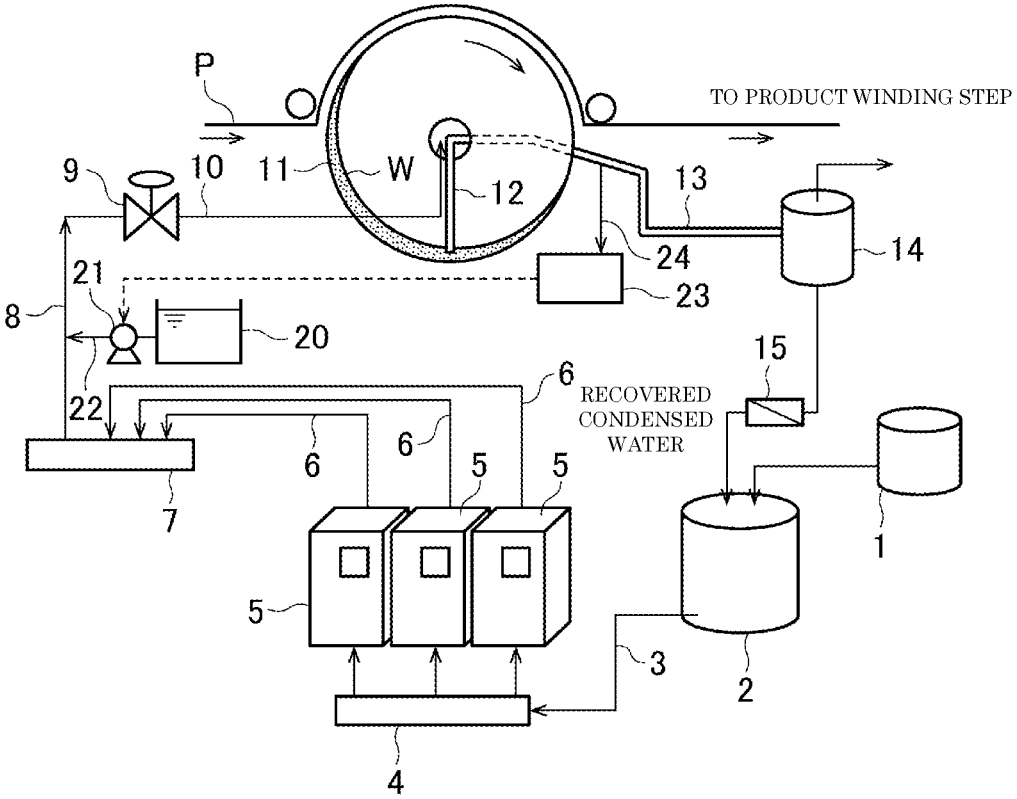
FIG. 1 is a system diagram illustrating one example of a wet paper drying facility to which the present invention is applied.

Hereinafter, the present invention will be described in detail.

<Application to a Steam Dryer>

In the present invention, when a material to be heated is heated with the steam via a metallic material, a condensed water film formation-suppressing amine, and as required, further other chemical agents such as a neutralizing amine and a deoxidizing agent are added to cause these chemical agents to be present in the steam system. These chemical agents will be described later.

The metallic material suffices if being one excellent in durability and high in the heat transfer efficiency, and includes iron-based materials and copper-based materials, but may also be a light metal material such as an aluminum-based material.

The material to be heated is not especially limited. The present invention can suitably be applied to, for example, heating and drying of wet paper in papermaking facilities, and heating and drying of wet paper having gone out from press and water-squeeze sections in production facilities for household raw paper materials such as tissue paper, toilet paper, kitchen paper and paper diapers, one side-glazed packing paper, and the like.

The present invention can also be applied to a heating or cooling step using steam in usual heat exchangers like plate type heat exchangers.

The present invention can also be applied to the case where the condensed water film formation-suppressing amine and the neutralizing amine are added to the water-steam system by being concurrently added to feed-water for a boiler.

It is especially preferable, from the viewpoint of the condensed water film formation-suppressing effect, that control of the chemical injection of the condensed water film formation-suppressing amine according to the present invention is applied to a steam dryer in which a condensed water film is easily formed by a centrifugal force by rotation of the metallic material intervening between the material to be heated and steam when the material to be heated is heated with the steam. Specifically, the present invention is suitable for various types of rotary type papermaking machine dryers, including a Yankee dryer illustrated in FIG. 2 and multi-cylinder type dryers.

When a chemical agent such as the condensed water film formation-suppressing amine is added to these steam dryers, the addition place therefor suffices as long as the chemical agent such as the condensed water film formation-suppressing amine is present in the steam system of the dryer, and is not especially limited. The chemical agent such as the condensed water film formation-suppressing amine may be added to feed-water of a steam generating facility, but addition thereof to a steam pipe or a steam header right before the dryer drum is preferable because consumption of the chemical agent until reaching the steam dryer is prevented and the needed amount of the chemical agent such as the condensed water film formation-suppressing amine to be added can thereby be reduced.

The addition of the chemical agent such as the condensed water film formation-suppressing amine may be carried out continuously or may be carried out intermittently. It is preferable, from the viewpoint that the condensed water film formation-suppressing amine is caused to be always present uniformly on the metal surface, that the condensed water film formation-suppressing amine is continuously injected and is caused to remain in a constant concentration in the drain.

<Items to be Analyzed and Controlled>

In the present invention, when the efficiency of heating with steam is enhanced due to addition of the condensed water film formation-suppressing amine in the heating step of heating the material to be heated with steam via the metallic material, the amount of the condensed water film formation-suppressing amine to be added is controlled based on the following items i) to vii) to be analyzed and controlled.

(i) Concentration of the condensed water film formation-suppressing amine in the drain
(ii) pH of the drain
(iii) Electroconductivity of the drain
(iv) Amount of the drain or the steam
(v) Temperature of the drain or the metallic material
(vi) Amount of the metallic material eluted in the drain
(vii) Tracer substance to be blended in a chemical agent The "drain" suffices as long as being a condensed liquid containing the condensed water film formation-suppressing amine; and its sampling place is not especially limited, and a drain of the steam dryer outlet is suitable.

The "temperature of the metallic material", when the metallic material is heated using the steam dryer, corresponds to the temperature of the steam dryer (for example, the temperature of the rotary drum).

The analysis of the water quality of the drain to be used for control of the chemical injection of the condensed water film formation-suppressing amine includes, as described above, the concentration of the condensed water film formation-suppressing amine, the pH, the electroconductivity and the amount of the metallic material eluted.

The chemical injection amount of the condensed water film formation-suppressing amine may be controlled based on the amount of the drain or the steam, or the temperature of the drain or the metallic material.

The chemical injection control may be carried out by combining two or more of the above-mentioned items to be analyzed and controlled.

The analysis of the concentration of the condensed water film formation-suppressing amine in the drain adopts, for example, a method of measuring the concentration by using coloring of Rose Bengal (Power Plant Chemistry, 2011, (13)10).

In the case of concurrent use of the condensed water film formation-suppressing amine and the neutralizing amine, the pH and the electroconductivity, and the temperature of the dryer, the temperature of the drain and start/stop signals of the dryer, by which the start/stop of the dryer are distinguished, and on-line microanalysis of the amount of the metallic material eluted may be used.

It is preferable that these are continuously fed back on-line for control of injection of the condensed water film formation-suppressing amine, but the amount thereof to be injected may be controlled based on off-line laboratory analysis.

In the following Table 1, cases of combinations of suitable items to be analyzed and controlled when the condensed water film formation-suppressing amine alone is added and when the condensed water film formation-suppressing amine and the neutralizing amine are added as a one-pack formulation are shown.

TABLE 1

Cases of Combinations of Chemical Agent Compositions with Items to be Analyzed and Controlled

| | Condensed Water Film Formation-Suppressing Amine Alone | Condensed Water Film Formation-Suppressing Amine + Neutralizing Amine (One-Pack Formulation) |
|---|---|---|
| Concentration of Condensed Water Film Formation-Suppressing Amine in Drain | ⊙ | ⊙ |
| pH of Drain | ○ | ⊙ |
| Electroconductivity of Drain | ○ | ⊙ |
| Amount of Drain | ⊙ | ⊙ |
| Amount of Steam | ⊙ | ⊙ |
| Drain Temperature/Metallic Material Temperature | ⊙ | ⊙ |
| Amount of Metallic Material Eluted | ⊙ | ⊙ |

* ⊙: best,
○: good

Figure 2:
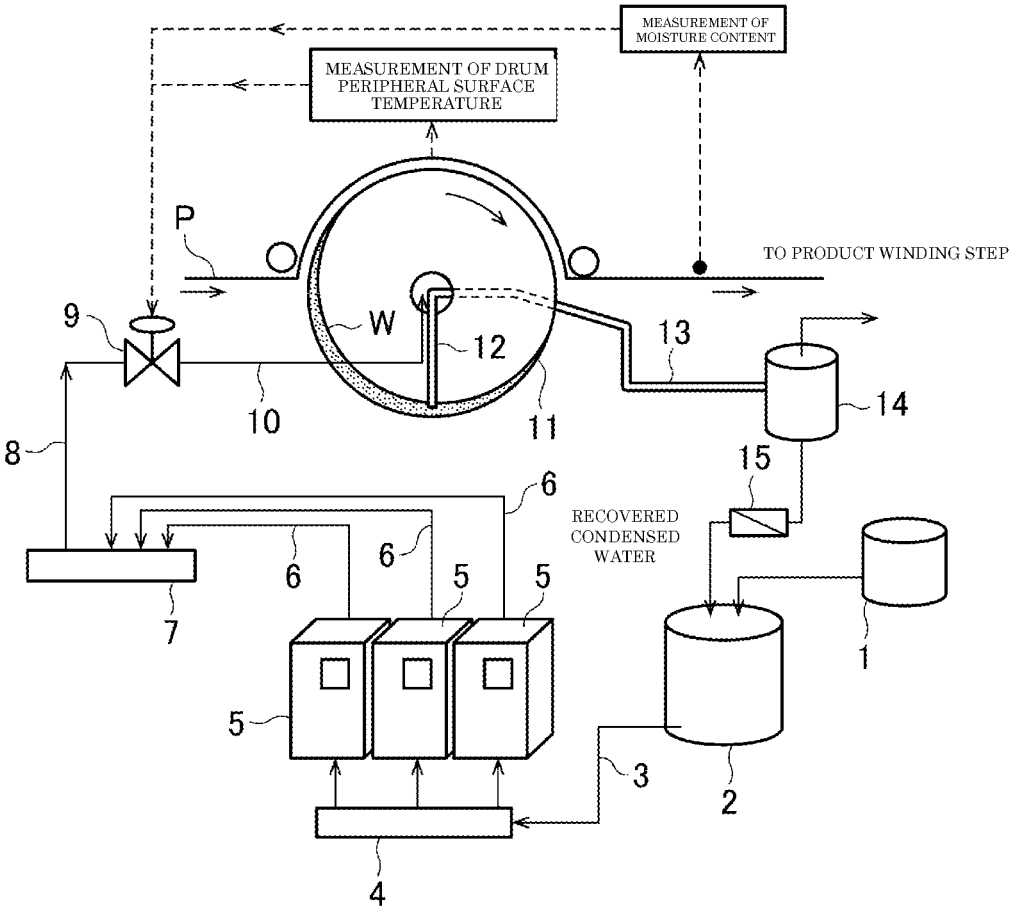
FIG. 2 is a system diagram illustrating one example of a wet paper drying facility.

FIG. 1 is a system diagram illustrating an example in which a wet paper drying facility illustrated in FIG. 2 is provided with a unit for controlling chemical injection to carry out the present invention, and the same reference signs are attached to members serving the same functions as members illustrated in FIG. 2.

Reference numeral 20 is a chemical agent tank, and a chemical agent containing a condensed water film formation-suppressing amine in the chemical agent tank 20 is injected from a chemical injection pipe 22 equipped with a chemical injection pump 21 into steam flowing in a pipe 8.

Reference numeral 23 is an analyzing device of a drain being condensed water from a drum 11. The analyzing device 23 is configured to: collect a part of the drain through a sampling pipe 24 branched from a pipe 13; analyze the concentration of the condensed water film formation-suppressing amine, the pH, the electroconductivity, the temperature and the amounts of constituting metallic materials of the drum 11 and the like by using the analyzing device 23; and control the chemical injection amount of the chemical agent such as the condensed water film formation-suppressing amine by adjustment of the rotation frequency of the chemical injection pump 21 based on the analysis results.

The drain collected through the pipe 24 for the analysis is discarded after the analysis. The control of the chemical injection amount may be carried out, other than the control of the rotation frequency of the chemical injection pump, by adjustment of a chemical injection valve opening or (in the case of a diaphragm) adjustment of operating time. The analyzing device may be installed directly on the pipe 13.

Although in FIG. 1, the facility is configured to sample a drain from a vicinity of a condensed water discharge port from the drum 11 of the steam dryer and analyze the sample by using the analyzing device 23, the place of the analyzing device is not limited to this place, and may be installed at a place of a water supply pipe from a flash tank 14 to a strainer 15 to analyze a flowing-out water of the flash tank 14.

The chemical injection place from the chemical agent tank 20 is not limited to the pipe 8 at all, either.

A specific method of control of the chemical injection for each item to be analyzed and controlled is as follows; and in any case, when the amount of the condensed water film formation-suppressing amine injected is too small, the condensed water film formation-suppressing effect and the heating efficiency-enhancing effect of the condensed water film formation-suppressing amine cannot sufficiently be attained, and when too much, tacky adhered substances may be produced in the system.

<Control of the Chemical Injection Based on the Concentration of the Condensed Water Film Formation-Suppressing Amine in the Drain>

The concentration of the condensed water film formation-suppressing amine in the drain is measured, and the chemical injection is controlled based on the measurement result so that the concentration of the condensed water film formation-suppressing amine in the drain falls in a predetermined range, for example, 0.2 to 0.3 ppm.

<Control of the Chemical Injection Based on the pH of the Drain>

The pH of the drain is measured, and the chemical injection is controlled based on the measurement result so that the pH of the drain falls in a predetermined range, for example, 9.0 to 9.3. Alternatively, when the pH of the drain rises, the chemical injection is considered to be excess, and the chemical injection amount of the condensed water film formation-suppressing amine is reduced within the predetermined range of the chemical injection amount. When the pH of the drain lowers, the chemical injection amount is considered to be deficient, and the chemical injection amount of the condensed water film formation-suppressing amine is increased within the predetermined range of the chemical injection amount.

<Control of the Chemical Injection Based on the Electroconductivity of the Drain>

The electroconductivity of the drain is measured, and the chemical injection is controlled based on the measurement result so that the electroconductivity of the drain falls in a predetermined range, for example, 0.3 to 0.5 mS/m. Alternatively, when the electroconductivity of the drain rises, the chemical injection is considered to be excess, and the chemical injection amount of the condensed water film formation-suppressing amine is reduced within the predetermined range of the chemical injection amount. When the electroconductivity of the drain lowers, the chemical injection amount is considered to be deficient, and the chemical injection amount of the condensed water film formation-suppressing amine is increased within the predetermined range of the chemical injection amount.

<Control of the Chemical Injection Based on the Amount of the Drain or the Amount of the Steam>

The amount of the drain or the amount of the steam is measured; and when the amount of the drain or the amount of the steam lowers, the chemical injection amount of the condensed water film formation-suppressing amine is reduced within the predetermined range of the chemical injection amount. When the amount of the drain or the amount of the steam increases, the chemical injection amount of the condensed water film formation-suppressing amine is increased within the predetermined range of the chemical injection amount.

It is preferable that the chemical injection is controlled so that the condensed water film formation-suppressing amine is, based on the amount of the steam, 0.01 to 10 ppm, especially 0.1 to 1 ppm.

Here, "ppm" is a proportion of the weight of the condensed water film formation-suppressing amine to the weight of water corresponding to the amount of the steam, and corresponds to "mg/L-water". The same applies to the amounts of a neutralizing amine and a deoxidizing agent to be added as described later.

<Control of the Chemical Injection Based on the Temperature of the Drain or the Temperature of the Metallic Material>

The temperature of the drain or the temperature of the metallic material, for example, the temperature of the dryer, is measured; and when the temperature of the drain or the temperature of the metallic material lowers, the machine is considered to have stopped and the chemical injection of the condensed water film formation-suppressing amine is stopped. When the temperature of the drain or the temperature of the metallic material rises, the machine is considered to be again in operation and the chemical injection of the condensed water film formation-suppressing amine is restarted within the predetermined range of the chemical injection.

<Control of the Chemical Injection Based on the Amount of the Metallic Material Eluted in the Drain>

The amount of the metallic material eluted in the drain is measured; when the amount of the metallic material eluted in the drain lowers, the chemical injection is considered to be excess, and the chemical injection amount of the condensed water film formation-suppressing amine is reduced within the predetermined range of the chemical injection amount. When the amount of the metallic material eluted in the drain increases, the chemical injection amount is considered to be deficient, and the chemical injection amount of the condensed water film formation-suppressing amine is increased within the predetermined range of the chemical injection amount.

<Application to the Papermaking Facility>

The method for enhancing the efficiency of heating with steam according to the present invention is suitably applied to the steam dryer installed in the papermaking facility, and carries out control of the chemical injection of a chemical agent such as the condensed water film formation-suppressing amine in corporation with the above-mentioned items to be analyzed and controlled.

In this case, it is preferable that the amount of steam to be supplied to the steam dryer is adjusted based on the amount of papermaking in the papermaking facility and the amount of the steam used in the steam dryer. By adjusting the amount of the steam according to the needed amount thereof, the steam consumption unit can be reduced and the production efficiency can be raised. Further, with the amount of the steam to be supplied to the steam dryer being fixed, the amount of papermaking can also be enhanced.

<Condensed Water Film Formation-Suppressing Amine>

The condensed water film formation-suppressing amine suffices as long as having the action and effect of suppressing the formation of the condensed water film in the steam system, for example, exhibiting the contact angle-increasing action of increasing the contact angle of the drum inner peripheral surface with water. The condensed water film formation-suppressing amine may be any of monoamines and polyamines such as diamines and triamines. The condensed water film formation-suppressing amine, as long as being in the range of not causing hindrance including generation of clogging of the strainer in the system, may be used singly or may be used concurrently in two or more in an optional combination and in an optional ratio.

Specific examples of the condensed water film formation-suppressing amine include, as monoamines, long-chain saturated aliphatic amines such as dodecylamine, tridecylamine, tetradecylamine, pentadecylamine, hexadecylamine, heptadecylamine, octadecylamine, nonadecylamine, eicosylamine and docosylamine, long-chain unsaturated aliphatic amines such as oleylamine, ricinoleylamine, linoleylamine and linolenylamine, mixed amines such as coconut oil amine and hydrogenated tallow amine, and mixtures thereof.

The polyamine represented by the following general formula (1) described in the above-cited Patent Literature 2 is preferable as the condensed water film formation-suppressing amine.

$$R^1—[NH—(CH_2)_m]_n—NH_2 \quad (1)$$

wherein $R^1$ represents a saturated or unsaturated hydrocarbon group having 10 to 22 carbon atoms; m is an integer of 1 to 8; and n is an integer of 1 to 7, provided that when n is 2 or more, a plurality of $NH—(CH_2)_m$ may be identical or different.

The saturated or unsaturated hydrocarbon group of $R^1$ may be of a straight-chain or a branched-chain, or cyclic. $R^1$ includes an alkyl group, an alkenyl group, an alkadienyl group and an alkynyl group, and is preferably a straight-chain alkyl group or a straight-chain alkenyl group. The number of carbon atoms of $R^1$ is preferably 15 to 22.

m is an integer of 1 to 8, and from the viewpoint of corrosion suppression, preferably an integer of 2 to 6. The $(CH_2)_m$ group includes a methylene group, an ethylene group (dimethylene group), a propylene group (trimethylene group) and a butylene group (tetramethylene group), and is preferably a propylene group.

n is preferably an integer of 1 to 3 from the viewpoint of corrosion suppression.

Specific examples of such polyamines include dodecylaminomethyleneamine, dodecylaminodimethyleneamine, dodecylaminotrimethyleneamine(N-stearyl-1,3-propanediamine), and tetradecyl, hexadecyl and octadecyl compounds corresponding to these polyamines, and octadecenylaminotrimethyleneamine, octadecenylaminodi-(trimethylamino)-trimethyleneamine, palmitylaminotrimethyleneamine and tallow alkyldiamine ethoxylates. N-oleyl-1,3-propanediamine (that is, N-octadecenylpropane-3-diamine), which is easily available in a sufficient purity, is preferable.

The condensed water film formation-suppressing amine may be dissolved in a solvent such as methanol, ethanol or isopropanol, and added to steam or feed-water. The condensed water film formation-suppressing amine may be made into an aqueous emulsion by using an emulsifier, and added to steam or feed-water. The emulsifier is preferably one having a high HLB (hydrophilic-lipophilic balance) value. The HLB of the emulsifier is preferably 12 to 16 and more desirably 13 to 15.

Examples of the emulsifier include polyoxyethylenealkylamine, and preferable is a polyoxyethylenealkylamine whose alkyl group has 10 to 18 carbon atoms.

As other emulsifiers, fatty acid alkali metal salts, particularly saturated or unsaturated fatty acid alkali metal salts having 8 to 24, particularly 10 to 22, carbon atoms can suitably be used. The fatty acid alkali metal salts specifically include sodium or potassium salts of saturated or unsaturated fatty acids such as capric acid, lauric acid, myristic acid, palmitic acid, stearic acid, arachic acid, behenic acid, oleic acid, erucic acid, linoleic acid and linolenic acid. As the fatty acid alkali metal salts, sodium salts or potassium salts of fatty acids produced from edible fat and oil are also preferable. As the fatty acid alkali metal salts, alkali metal salts of fatty acids containing 25% by weight or higher of at least one selected from the group consisting of, particularly, unsaturated fatty acids having 14 to 22 carbon atoms, for example, oleic acid, erucic acid, linoleic acid and linolenic acid, are suitable. As the emulsifier, besides, esters of glycerol with the above-mentioned fatty acids can also be suitably used, and esters with stearic acid are especially preferable.

These emulsifiers may be used singly or concurrently in two or more.

When the condensed water film formation-suppressing amine is made into an aqueous emulsion by using an emulsifier such as a fatty acid alkali metal salt, it is suitable that the blend proportion of the condensed water film formation-suppressing amine to the emulsifier is, in weight ratio (condensed water film formation-suppressing amine/emulsifier), 40/1 to 1/1, especially about 20/1 to 2/1.

<Other Chemical Agents>

In the present invention, together with the above-mentioned condensed water film formation-suppressing amine, other chemical agents may be concurrently used. For example, a neutralizing amine having a pH-adjusting function may also be concurrently used. The concurrent use of the neutralizing amine enables attaining the effect of reducing the corrosion rate of the steam dryer and the steam condensing pipes before and after the drum.

As the neutralizing amine, volatile amines such as ammonia, monoethanolamine (MEA), cyclohexylamine (CHA), morpholine (MOR), diethylethanolamine (DEEM, monoisopropanolamine (MIPA), 3-methoxypropylamine (MOPA), 2-amino-2-methyl-1-propanol (AMP) and diglycolamine (DGA) can be used. The neutralizing amines may be used singly or concurrently in two or more.

In place of the neutralizing amine, pH adjustment may be carried out using ammonia originated from thermal decomposition of the following deoxidizing agent.

In the case of the concurrent use of the neutralizing amine, it is preferable that the amount of the neutralizing amine to be added is 0.1 to 50 ppm, especially 1 to 30 ppm based on the amount of steam, though depending on the amount of the condensed water film formation-suppressing amine to be used, the kind of the material to be heated, the type of the steam dryer, and the like.

Since the pH and the electroconductivity more easily rise when the neutralizing amine and the condensed water film formation-suppressing amine are used as a chemical agent in a one-pack formulation than in the case of the condensed water film formation-suppressing amine alone, the management of the injection amount may be carried out based not on the concentration of the condensed water film formation-suppressing amine but, as indicated in the above-cited Table 1, on the pH and the electroconductivity.

A deoxidizing agent may be used concurrently together with the condensed water film formation-suppressing amine. The concurrent use of the deoxidizing agent enables, similarly to the neutralizing amine, attaining the effect of reducing corrosion in the steam dryer and the like.

As the deoxidizing agent, hydrazine derivatives such as hydrazine and carbohydrazide can be used. As non-hydrazine-based deoxidizing agents, carbohydrazide, hydroquinone, 1-aminopyrrolidine, 1-amino-4-methylpiperazine, N, N-diethylhydroxylamine, isopropylhydroxylamine, erythorbic acid or salts thereof, ascorbic acid or salts thereof, tannic acid or salts thereof, saccharides, sodium sulfite, and the like can also be used. These may be used singly or concurrently in two or more.

In the case of the concurrent use of the deoxidizing agent, it is preferable that the amount of the deoxidizing agent to be added, though depending on the amount of the condensed water film formation-suppressing amine used, the kind of the material to be heated, the type of the steam dryer and the like, is 0.01 to 3 ppm, especially 0.05 to 1 ppm, based on the amount of the steam.

The above-mentioned chemical agents to be concurrently used may be added to the same place as for the condensed water film formation-suppressing amine, or may be added to different places. In the case of adding two or more chemical agents to the same place, the chemical agents to be added may be previously mixed and then added, or may be added separately. As the tracer substance, these may be used concurrently. In this case, use of a material which is a volatile substance and whose analysis is simple is preferable. For example, N,N-diethylhydroxylamine or ammonia is suitable.

EXAMPLES

Hereinafter, Example and Comparative Examples will be described.

In the description below, the steam consumption unit was calculated as a proportion of the amount of steam used (t) to the amount of paper produced (amount of papermaking) (t) excluding paper having generated defects.

Example 1

In the papermaking and drying facility (here, the chemical injection place from the chemical agent tank 20 was set at the water vapor header 7) illustrated in FIG. 1, the drum diameter of the Yankee dryer was 3 m; the pressure of water vapor supplied was set at 0.6 MPa; the amount of the water vapor supplied was set at about 900 kg/h; and the amount of the water vapor supplied to the Yankee dryer was controlled using a flow rate regulating valve 9 so that the outer surface temperature of the drum was 100° C. and the moisture content of a product (paper) after drying was 20 to 30%.

As the condensed water film formation-suppressing amine, N-octadecenylpropane-1,3-diamine was used; and as the neutralizing amine, cyclohexylamine was used. The polyamine was emulsified with polyoxyethylenecocoamine, and added. The amounts of the polyoxyethylenecocoamine and the cyclohexylamine blended were 15 parts by weight and 500 parts by weight, respectively, per 100 parts by weight of the N-octadecenylpropane-1,3-diamine. As the tracer substance of the condensed water film formation-suppressing amine, 5 parts by weight of DEHA (N,N-diethylhydroxylamine) was added.

The concentration of N-octadecenylpropane-1,3-diamine in a dryer drain from the drum 11 was measured by the coloring method using Rose Bengal by using the analyzing device 23. Based on this measurement result, the chemical injection was controlled so that the concentration of N-octadecenylpropane-1,3-diamine in the dryer drain was 0.3 ppm.

As a result, the steam consumption unit before the addition was 2.94, but the steam consumption unit, after the addition of N-octadecenylpropane-1, 3-diamine, was improved to 2.81.

During the test, no clogging of the strainer of the papermaking and drying facility was generated.

Results are shown in Table 2. The measurement results using Rose Bengal and the analysis results using DEHA had a good correlation.

In Example 1, due to the above-mentioned control of the chemical injection, the amount per steam of N-octadecenylpropane-1,3-diamine injected varied in the range of 0.2 to 0.3 ppm.

Comparative Examples 1, 2

The steam consumption unit and the presence/absence of clogging of the strainer were examined as in Example 1, except for carrying out no control of the chemical injection of N-octadecenylpropane-1,3-diamine and fixing the chemical injection amount of N-octadecenylpropane-1,3-diamine at a fixed amount of 1.0 ppm. Results are shown in Table 2. In Comparative Example 1, during the test, the operation of the apparatus was stopped for a while. In Comparative Example 2, a paper of a kind having some thickness was produced during the test.

TABLE 2

Example and Comparative Examples

| | Clogging of Strainer | Steam Consumption Unit before addition | Steam Consumption Unit after addition | Remarks |
|---|---|---|---|---|
| Example 1 | absent | 2.94 | 2.81 | optimized by injection amount control |
| Comparative Example 1 | present | 2.93 | 2.81 | excess injection (apparatus stop period was present) |
| Comparative Example 2 | absent | 2.95 | 2.87 | injection-deficient period was present |

From the results of Example 1 and Comparative Examples 1 and 2, it is clear that according to the present invention, since there is no excess and deficiency of the effective concentration of the chemical agent and the efficiency of heating with steam can be further enhanced, the stable operation raised in the production efficiency of papermaking facilities and the like can be continued.

Comparative Example 1 had a period when the operation of the apparatus was stopped during the test, and in the period, the chemical injection was excess and clogging of the strainer was generated.

In Comparative Example 2, the amount of steam increased due to the production of the paper of a kind having some thickness during the test; consequently, deficiency of the chemical agent lowered as a whole the ratio of the amount of N-octadecenylpropane-1,3-diamine added to the amount of steam, and there was a period when the remaining concentration of the N-octadecenylpropane-1,3-diamine was lower than 0.1 ppm. Consequently, although no clogging of the strainer was generated, the effect of enhancing the steam consumption unit was not sufficient.

The present invention has been described by way of specific embodiments, but it is obvious to those skilled in the art that various changes and modifications may be made without departing from the aim and the scope of the present invention.

The present application is based on Japanese Patent Application No. 2018-025228, filed on Feb. 15, 2018, the entire disclosure of which is hereby incorporated by reference.

REFERENCE SIGNS LIST

4 FEED-WATER HEADER
5 BOILER
7 WATER VAPOR HEADER
11 DRUM
12 SIPHON

20 CHEMICAL AGENT TANK
23 ANALYZING DEVICE
P WET PAPER
W CONDENSED WATER

The invention claimed is:

1. A method for enhancing efficiency of heating with steam, comprising:

adding a condensed water film formation-suppressing amine in a heating step of heating a material to be heated with the steam using a steam dryer via a metallic material, wherein the condensed water film formation-suppressing amine is added in the steam at a steam pipe or a steam header for supplying steam to the steam dryer that are disposed right before the steam dryer, and an amount of the condensed water film formation-suppressing amine to be added is controlled based on any one or more of a concentration of the condensed water film formation-suppressing amine in a drain, a pH of the drain, an amount of the drain, an amount of the steam, a temperature of the drain, a temperature of the metallic material, and an amount of the metallic material eluted in the drain, wherein the condensed water film formation-suppressing amine is one or more of polyamines represented by the following general formula (1):

$$R^1—[NH—(CH_2)_m]_n—NH_2 \quad (1)$$

wherein $R^1$ represents a saturated or unsaturated hydrocarbon group having 10 to 22 carbon atoms; m is an integer of 1 to 8; and n is an integer of 1 to 7, provided that when n is 2 or more, a plurality of $NH—(CH_2)_m$ may be identical or different, and wherein in the heating step, the condensed water film formation-suppressing amine and a neutralizing amine are caused to be concurrently present.

* * * * *